US007448856B2

(12) United States Patent
Girod et al.

(10) Patent No.: US 7,448,856 B2
(45) Date of Patent: Nov. 11, 2008

(54) FAN

(75) Inventors: Xavier Girod, Montluel (FR); Eric Icarre, Bressolles (FR); Michel El Baz, Feyzin (FR)

(73) Assignee: Carrier Corporation, Farmington, CT (US)

( * ) Notice: Subject to any disclaimer, the term of this patent is extended or adjusted under 35 U.S.C. 154(b) by 550 days.

(21) Appl. No.: 10/950,267

(22) Filed: Sep. 24, 2004

(65) Prior Publication Data

US 2006/0073018 A1 Apr. 6, 2006

(51) Int. Cl.
*F04D 29/20* (2006.01)

(52) U.S. Cl. ..... 416/234; 416/241 A; 416/244 R; 29/889.1

(58) Field of Classification Search ..... 416/234, 416/241 A, 240; 29/889.1
See application file for complete search history.

(56) References Cited

U.S. PATENT DOCUMENTS 2,454,200 A * 11/1948 Perkins ..... 416/233
3,061,342 A * 10/1962 Feller ..... 403/15

* cited by examiner

*Primary Examiner*—Ninh H Nguyen
(74) *Attorney, Agent, or Firm*—Bachman & LaPointe, P.C.

(57) ABSTRACT

A fan assembly has a central metallic element and a polymeric fan. The polymeric fan has a hub carrying the central metallic element and has a plurality of blades extending from the hub. The central metallic element has a central longitudinal aperture and a lateral surface. The central metallic element lateral surface is of substantially uniform substantially square section along a majority of a length of the central metallic element.

20 Claims, 3 Drawing Sheets

FAN

BACKGROUND OF THE INVENTION (1) Field of the Invention

The invention relates to heating ventilation and air conditioning (HVAC) systems. More particularly, the invention relates to fans for such systems.

(2) Description of the Related Art

Fans are ubiquitous in HVAC systems. Many fan configurations exist. A typical electric fan includes a motor having a shaft protruding from one end. A fan assembly is mounted to the shaft so as to be driven by the motor. One group of fan assembly configurations involves molding a plastic component over a metallic hub insert. The plastic component includes a hub surrounding the insert and blades radiating outward from the hub. The plastic component may further include a shroud at outboard ends of the blades. In such configurations, the use of plastic generally provides lightness and ease of manufacturing and the use of a metallic insert provides a robust precise connection to the motor shaft. The engineering of the insert and its interface with the plastic component presents a number of considerations. The insert may, advantageously, be light. The insert requires an appropriate robust interface with the plastic component to reliably transmit torque and thrust. Various forms of fluting and other complex surface configurations have been proposed to achieve advantageous performance.

SUMMARY OF THE INVENTION

One aspect of the invention is a fan assembly. A central metallic element has a central longitudinal aperture and a lateral surface. A polymeric fan has a hub carrying a central metallic element and a number of blades extending from the hub. The central metallic element lateral surface is of substantially uniform, substantially square section along a majority of a length of the central metallic element.

In various implementations, the central metallic element lateral surface may have a groove. The central metallic element may consist essentially of brass or bronze. The central metallic element may have a pair of off-center threaded bores open to a forward end of the central metallic element. The central metallic element longitudinal aperture may include a keyway extending from a central circular-section bore. A polymeric cover may be secured at a forward end of the hub. The polymeric fan may further include a shroud, unitarily formed with the blades. A web portion of the polymeric fan may overlie a perimeter portion of an aft surface of the central metallic member. The fan assembly may be combined with a motor. The motor may have a shaft having a portion accommodated within the central longitudinal aperture and secured to the central metallic element against rotation. A stator may be coupled to the shaft so as to drive the fan.

The fan assembly may be manufactured by cutting a precursor of the central metallic element from a square-section bar. The central longitudinal aperture may be machined. A recess may be machined in the lateral surface. The fan may be molded over the central metallic element so that material of the fan enters the recess. The central metallic element may be first mounted in a mold for the molding of the fan.

Another aspect of the invention involves a method for remanufacturing an electric fan. A first fan assembly is removed from a motor. The first fan assembly includes a first central metallic element having a first central longitudinal aperture and a first lateral surface. The first fan assembly further includes a first polymeric fan having a first hub carrying the first central metallic member. A second fan assembly may be installed to the motor. The second fan assembly includes a second central metallic element having a second central longitudinal aperture and a second lateral surface. The second fan assembly includes a second polymeric fan having a second hub carrying the second central metallic element. The second lateral surface is of substantially uniform, substantially square section along a majority of a length of the second central metallic element.

In various implementations, the second metallic element may be heavier than the first metallic element (e.g., by at least 5%, 10%, 25%, or more). The first metallic element may have a more complex shape than the second metallic element (e.g., in principal transverse section).

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
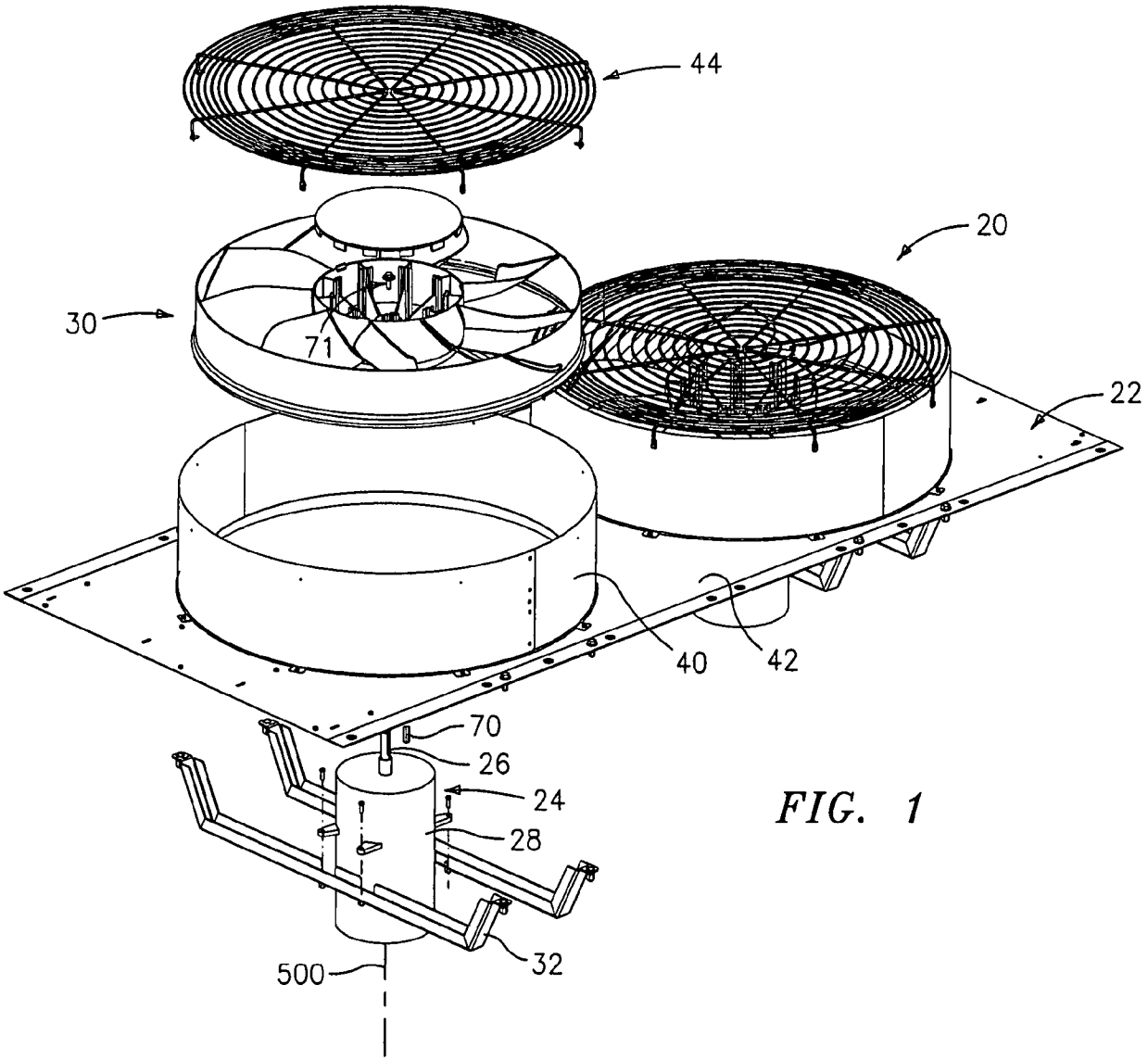
FIG. 1 is a partially exploded view of a pair of electric fan units.

FIG. 1 shows a pair of electric fan units 20 mounted from a duct component 22 of an HVAC system. Each fan unit includes an electric motor 24 having a shaft 26 with a portion protruding from the housing or case 28 containing a stator (not shown). In operation, the motor shaft is driven about a common central longitudinal axis 500 of the fan unit. The fan unit further includes a fan assembly 30 mounted to the protruding portion of the shaft.

In the exemplary embodiment, each fan unit is mounted to the duct assembly by a pair of mounting brackets 32. In the exemplary embodiment, each fan assembly 30 is concentrically mounted within an annular cylindrical duct 40 extending from a proximal end at a flat wall 42 to a distal end carrying a grill 44. Other configurations are possible.

Figure 3:
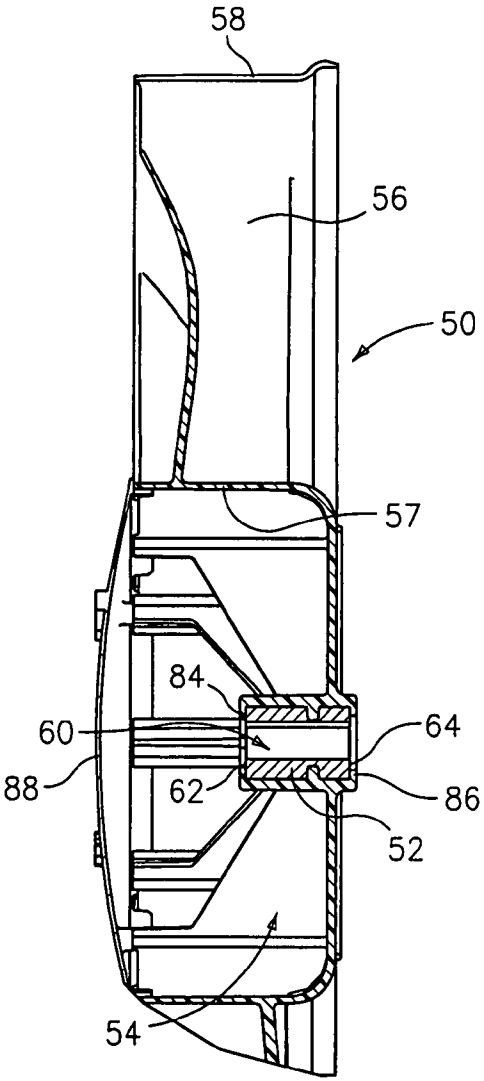
FIG. 3 is a partial longitudinal sectional view of the fan assembly of FIG. 2.
Figure 2:
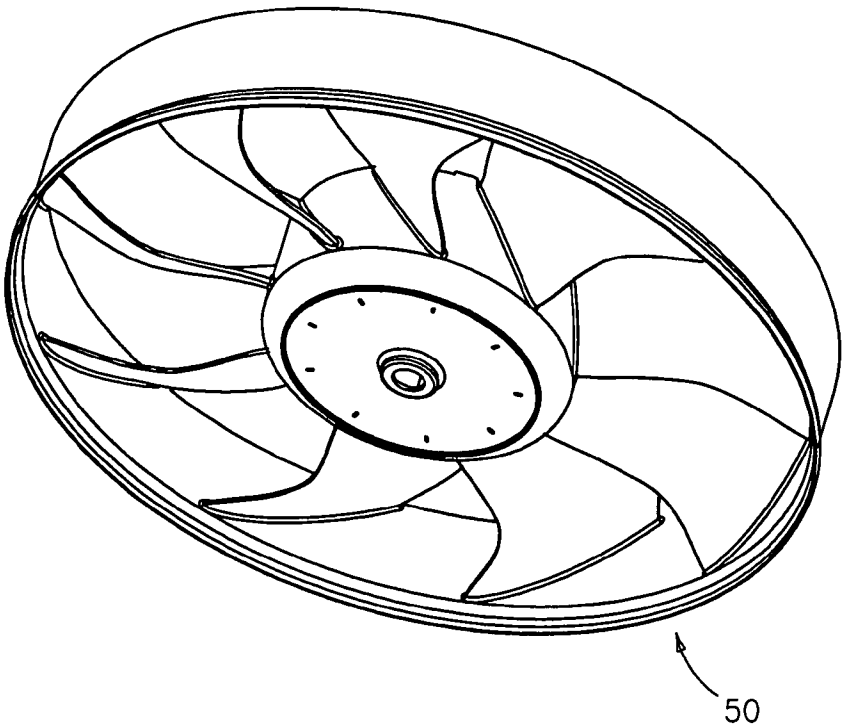
FIG. 2 is a view of a fan assembly of one of the units of FIG. 1.
Figure 4:
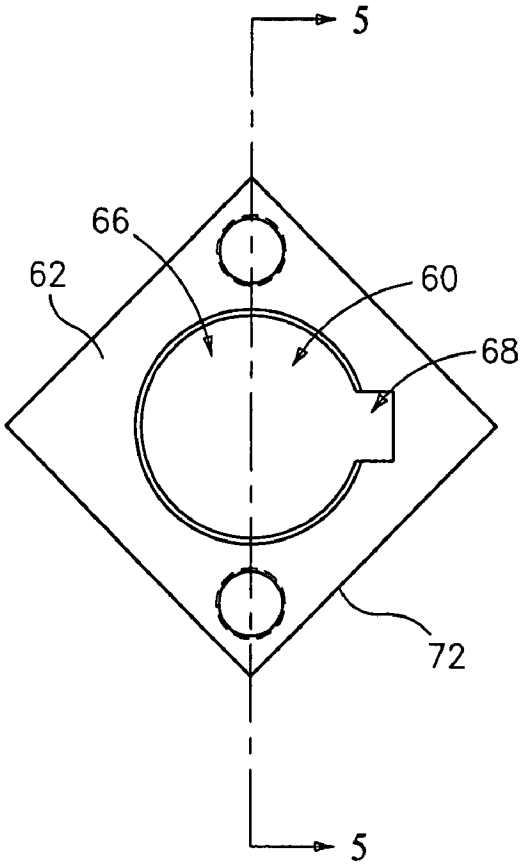
FIG. 4 is a front end view of an insert of the fan assembly of FIG. 2.

FIGS. 2 and 3 show further details of the exemplary fan assembly 30. The fan assembly 30 includes the combination of a molded plastic component 50 (FIG. 2) and a metallic insert 52 (FIG. 3). The metallic insert is at least partially embedded in a hub portion 54 of the molded component from which unitarily-formed blades 56 radiate outward from inboard root ends at a sidewall 57 of the hub. In the exemplary embodiment, the molded component further includes an annular shroud 58 at the blade outboard ends. The metallic insert includes a central longitudinal aperture 60 for receiving the protruding end of the motor shaft. The exemplary central aperture 60 extends between first (front) and second (rear) end surfaces 62 and 64 of the metallic insert and consists essentially of a right circular cylindrical bore 66 (FIG. 4) coaxial with the fan axis and a slot-like keyway 68 extending radially outward from at least a portion of the bore. The keyway receives a portion of a key 70 (FIG. 1) of which a second portion is similarly received in a keyway in the shaft to lock the metallic insert to the shaft against relative rotation. A screw, bolt, or similar fastener 71 (FIG. 1) may have a threaded shaft extending into a threaded aperture in the motor shaft and a head bearing against (e.g., via a washer) the front surface 62 to prevent unintended longitudinal ejection of the fan.

Figure 5:
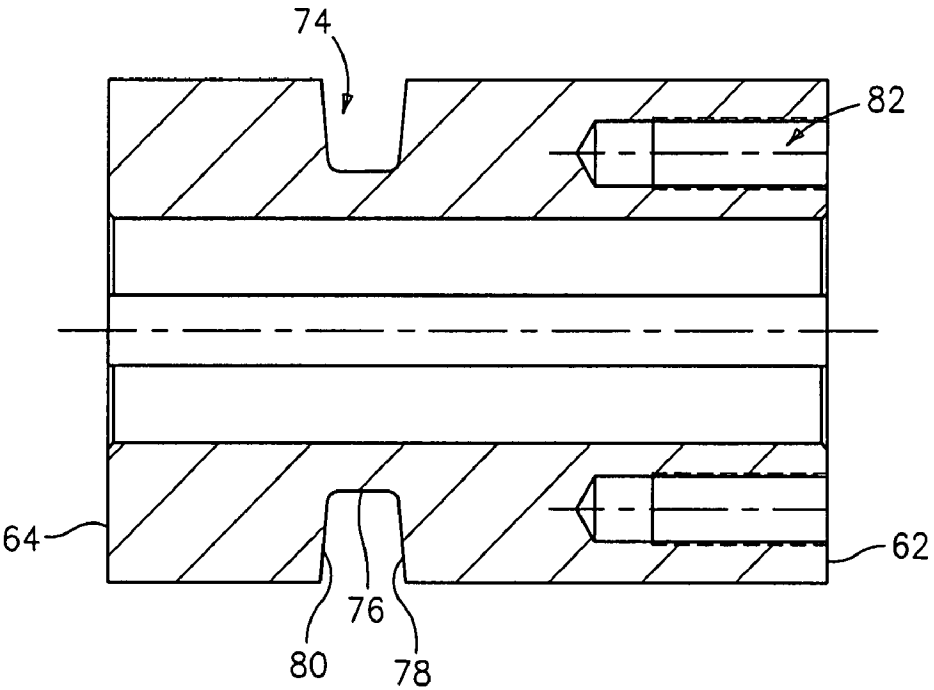
FIG. 5 is a longitudinal sectional view of the insert of FIG. 4, taken along line 5-5.

The metallic insert 52 has a lateral surface characterized by four facets 72 (FIG. 4) defining a square cross-section. The square cross-section may correspond to bar stock (e.g., brass) from which the insert is cut. In the exemplary embodiment, to improve longitudinal engagement between the insert and the molded component, there may be one or more recesses 74 (FIG. 5) in the lateral surface. An exemplary recess comprises a near-right annular channel having a circular cylindrical base 76 and a pair of near-radial sidewalls 78 and 80 with slightly radiused transitions. Additionally, the exemplary embodiment includes a pair of blind threaded bores 82 extending longitudinally inward from the front surface 62. The bores 82 are off-center and aid in fan extraction from the motor/shaft as is discussed in further detail below.

In an exemplary process of manufacture, insert precursors are cut from square-section bar stock. The cutting (which may include one or more stages such as rough cutting and surface milling) essentially defines the end surfaces and the principal portion of the lateral surface. The cut precursor may be fixtured (e.g., in a lathe or similar tool) and the central bore 66 drilled and the channel 74 cut. The precursor may then be refixtured for milling the keyway 68 and again refixtured for drilling and tapping the bores 82.

After the insert has been formed, it may be registered in a portion of a die (not shown) for molding the molded component 50. The die may be assembled and plastic (e.g., glass-reinforced polypropylene) injected to form the molded component. The exemplary molding nearly entirely embeds the insert within the hub. In the exemplary embodiment, webs 84 and 86 (FIG. 3) of the molded material extend along outboard portions of the insert ends 62 and 64, having apertures therein to expose the channel at both ends and bores at the front end 62. The apertures advantageously extend sufficiently radially beyond the channel to permit engagement of the fastener 71 to the front end 62 (e.g., by accommodating a washer) and engagement of a shoulder on the motor shaft with the aft end 64 so as to longitudinally clamp the insert (e.g., via direct compressive contact). With the motor preinstalled in the appropriate environmental structure, the combination of the molded component and insert may be installed to the shaft (e.g., by sliding the insert over the shaft 26 and key 70 and installing the fastener 71 and/or by press/interference fitting). Thereafter, a cover (e.g., also molded plastic such as unreinforced polypropylene) 88 (FIG. 3) may be placed over the hub (e.g., via snap fit within a perimeter of the hub).

To remove the fan assembly from the motor, the hub cover may first be removed from the hub (e.g., by disengaging the snap fit via prying or other extraction). The fastener 71 may then be removed by unthreading. A removal tool (not shown) may be installed to the hub assembly. An exemplary removal tool includes threaded shafts (not shown) threaded into engagement with the bores 82 and retained by a tool body structure spanning such shafts. A central jack screw (not shown) may extend longitudinally between and parallel to the threaded shafts and may be rotated until its distal end contacts the motor shaft front end, with further rotation extracting the fan assembly from the motor shaft via a jacking action.

For the insert, square bar stock is relatively inexpensive source material (e.g., as compared with stock of more convoluted section). By limiting subsequent machining so as to leave a major portion of the cross-section intact, subsequent manufacturing costs are reduced (e.g., as compared with machining a complex profile such as fluting along a greater portion of the length of the insert). Thus, the present teachings may be used to form a less complex and less expensive insert than would otherwise be used. Relative to such a more complex insert, the alternative insert may be larger in cross-sectional area and thus greater in weight and may have a slightly less robust anti-torque engagement with the hub. Nevertheless, the square section may provide sufficient anti-torque engagement and the increased mass may slightly, if not negligibly, affect inertia (especially due to the relatively small radius at which most of the insert's mass exists). Accordingly, the present teachings may be used to design an insert to replace a more complex (and expensive) insert either for engineering the configuration of a new electric fan based upon an existing electric fan or as a remanufacturing of the existing electric fan.

One or more embodiments of the present invention have been described. Nevertheless, it will be understood that various modifications may be made without departing from the spirit and scope of the invention. For example, when implemented as a reengineering or remanufacturing of an existing electric fan, details of the existing fan may influence details of any particular implementation. Accordingly, other embodiments are within the scope of the following claims.

What is claimed is:

1. A fan assembly comprising:

a central metallic element having:

a central longitudinal aperture; and a lateral surface; and a polymeric fan having:

a hub carrying the central metallic element; and a plurality of blades extending from the hub, wherein the central metallic element lateral surface is of substantially uniform, substantially square section along a majority of a length of the central metallic element and the central metallic element has a pair of off-center threaded bores open to a forward end of the central metallic element.

2. The fan assembly of claim 1 wherein the central metallic element lateral surface has a groove.

3. The fan assembly of claim 1 wherein the central metallic element consists essentially of brass or bronze.

4. The fan assembly of claim 1 wherein the central longitudinal aperture comprises a keyway extending from a central circular-section bore.

5. The fan assembly of claim 1 further comprising a polymeric cover secured at a forward end of the hub.

6. The fan assembly of claim 1 wherein the polymeric fan further comprises a shroud, unitarily formed with the blades.

7. The fan assembly of claim 1 wherein a web portion of the polymeric fan overlies a perimeter portion of an aft surface of the central metallic member but leaving a portion inboard of the perimeter portion exposed.

8. The fan assembly of claim 1 in combination with a motor having:

a shaft having a portion accommodated within the central longitudinal aperture and secured to the central metallic element against rotation; and a stator coupled to the shaft so as to drive the fan.

9. A method for manufacturing the fan assembly of claim 1 comprising:

cutting a precursor of said central metallic element from a square-section bar;

machining the central longitudinal aperture;

machining a recess in the lateral surface; and molding the fan over the central metallic element so that material of the fan hub enters the recess.

10. The method of claim 9 further comprising:

mounting the central metallic element in a mold for said molding.

11. A method for remanufacturing an electric fan comprising:

removing a first fan assembly from a motor, the first fan assembly comprising:

a first central metallic element having:

a first central longitudinal aperture; and a first lateral surface; and a first polymeric fan having:

a first hub carrying the first central metallic element; and installing a second fan assembly to the motor, the second fan assembly comprising:

a second central metallic element having:

a second central longitudinal aperture; and a second lateral surface; and a second polymeric fan having:

a second hub carrying the second central metallic element, wherein:

the second lateral surface is of substantially uniform substantially square section along a majority of a length of the second central metallic element;

a web portion of the polymeric fan overlies a perimeter portion of an aft surface of the second central metallic element; and the installing engages a shoulder of a shaft of the motor to a portion of the aft surface inboard of the web.

12. The method of claim 11 wherein:

the second metallic element is heavier than the first metallic element.

13. The method of claim 11 wherein:

the first metallic element has a more complex shape than the second metallic element.

14. A fan assembly comprising:

a central metallic element having:

a central longitudinal aperture; and a lateral surface of substantially uniform, substantially square section along a majority of a length of the central metallic element;

a polymeric fan having:

a hub carrying the central metallic element; and a plurality of blades extending from the hub; and a polymeric cover secured at a forward end of the hub.

15. The fan assembly of claim 14 wherein the central metallic element lateral surface has a groove.

16. The fan assembly of claim 14 wherein the central metallic element consists essentially of brass or bronze and the polymeric fan further comprises a shroud, unitarily formed with the blades.

17. The fan assembly of claim 14 wherein the central longitudinal aperture comprises a keyway extending from a central circular-section bore.

18. The fan assembly of claim 14 wherein the central metallic element consists essentially of brass or bronze and the polymeric fan further comprises a shroud, unitarily formed with the blades.

19. A fan assembly comprising:

a central metallic element having:

a central longitudinal aperture; and a lateral surface of substantially uniform, substantially square section along a majority of a length of the central metallic element; and a polymeric fan having:

a hub carrying the central metallic element and having a web portion overlying a perimeter portion of an aft surface of the central metallic member but leaving a portion inboard of the perimeter portion exposed.

20. The fan assembly of claim 19 wherein the central metallic element lateral surface has a groove.

* * * * *